United States Patent [19]

Schreurs et al.

[11] Patent Number: 4,714,974

[45] Date of Patent: Dec. 22, 1987

[54] CURRENT LIMITER

[75] Inventors: Emile Schreurs; Stefan Joader; Stefan Valdemarsson, all of Västerås, Sweden

[73] Assignee: Asea Aktiebolag, Västerås, Sweden

[21] Appl. No.: 944,528

[22] Filed: Dec. 22, 1986

[51] Int. Cl.[4] ..... H01H 9/30; H01H 33/00

[52] U.S. Cl. ..... 361/12; 200/144 AP; 361/138

[58] Field of Search ..... 361/12, 126, 128, 138; 200/144 AP

[56] References Cited

U.S. PATENT DOCUMENTS

| | | | |
|---|---|---|---|
| 1,177,336 | 3/1916 | Jackson | 361/12 |
| 1,224,150 | 5/1917 | Davis | 200/144 AP |
| 1,944,402 | 1/1934 | Clerc | 200/144 AP |
| 3,495,056 | 2/1970 | Jensen | 200/144 AP |
| 3,728,505 | 4/1973 | McConnell | 200/144 AP |

FOREIGN PATENT DOCUMENTS

| | | | |
|---|---|---|---|
| 800004 | 4/1936 | France | 361/138 |

*Primary Examiner*—Robert S. Macon

*Attorney, Agent, or Firm*—Watson, Cole, Grindle & Watson

[57] ABSTRACT

A current limiter for high voltage utilizes the high migration velocity of an arc for rapidly inserting at least one pair of resistive runner rails upon a short-circuit in a circuit. To be able simultaneously to fulfil the demands for a high energy absorption capacity and sufficient resistance per unit of length of the runner rails, the runner rails are made of a relatively thin, insulated tape of an electrically conductive material, which is folded and packed to form a solid resistance package. Between the two runner rails in each pair of rails there extend two parallel walls of insulating material, which form between them a narrow gap for the arc. The magnetic field in the gap is reinforced with the aid of a magnetic core and/or current loops.

10 Claims, 8 Drawing Figures

CURRENT LIMITER

TECHNICAL FIELD

The present invention relates to a current limiter of the kind comprising a contact means having at least two cooperating contacts, at least one of which is movable, connecting members for connecting the current limiter into a circuit, and at least two substantially parallel, resistive runner rails adjacent to the contact means, the runner rails causing the arc produced upon contact opening when a short-circuit current flows in the circuit, under the influence of the magnetic field generated by the current, to move away from the contact means with the foot points of the arc running along the rails, an increasing resistance being inserted into the circuit. The current limited is primarily intended for the intermediate and high voltage ranges (i.e. voltages exceeding 1 kV), but in principle it may be employed for low voltage as well.

BACKGROUND ART

Proposals have been made in the past to utilize the high migration velocity of an arc to rapidly insert resistive runner rails into a circuit exposed to short-circuit currents. British Pat. Nos. 1 499 486 and 1 568 766 describe designs of this kind, in which the runner rails consist of straight or helically formed stiff bars.

In order to achieve an efficient current limitation upon a short-circuit in an a.c. circuit, with designs operating according to the above-mentioned principle, a considerable resistance must be inserted into the circuit even during the first milliseconds of the short-circuit period. Since the migration velocity of the arc admittedly is high but limited (500–1000 m/s), this rapid resistance insertion is only possible if the runner rails have a sufficiently high resistance per unit of length. At the same time the rails must have a high energy-absorption capacity, since no essential thermal dissipation by cooling is possible because of the rapid process. The designs described in the above-mentioned patent specifications do not fulfil the demand which - in these respects - are placed on current limiters for intermediate and high voltage.

Proposals have also been made to design a current limiter with two meander-shaped resistors made of insulated metallic tape and located opposite to each other, said resistors being inserted into the circuit with the aid of a current collector, being displaceable in the gap between the resistors (Swedish Pat. No. 192 481). With such a design it is difficult to achieve a sufficiently rapid insertion of the resistors in order to obtain an efficient current limitation.

DISCLOSURE OF THE INVENTION

The present invention aims to provide a current limiter of the kind comprising a contact means having at least two cooperating contacts, at least one of which is movable, connecting members for connecting the current limiter into a circuit, and at least two substantially parallel, resistive runner rails adjacent to the contact means, the runner rails causing the arc produced upon contact opening when a short-circuit current flows in the circuit, under the influence of the magnetic field generted by the current, to move away from the contact means with the foot points of the arc running along the rails, an increasing resistance being inserted into the circuit. The current limiter is designed for intermediate and high voltage and which, at the same time, fulfils the demands for a high energy absorption capacity and sufficient resistance per unit of length of the runner rails. This is accomplished by designing the runner rails so that each runner rail comprises an insulated tape made of an electrically conductive material and being folded and packed to form a solid resistance package, the confronting surfaces of the two runner rails being at least partially uninsulated to form running paths for the foot points of the arc.

By making the runner rails of an insulated metallic tape, which is foled and packed together into a solid resistance package, several advantages are obtained. Since the tape is thin in relation to the width and since antiparallel current paths arise, the inductance will be extremely low, which enables a fast travelling of the arc. By the choice of thickness and width of the tape as well as length of folding, an arbitrary resistance per unit of length can be obtained for a given amount of energy to be absorbed.

BRIEF DESCRIPTION OF THE DRAWING

The invention will be described in greater detail with reference to a number of embodiments shown in the accompanying drawing, wherein.

DESCRIPTION OF THE PREFERRED EMBODIMENTS

Figure 1:
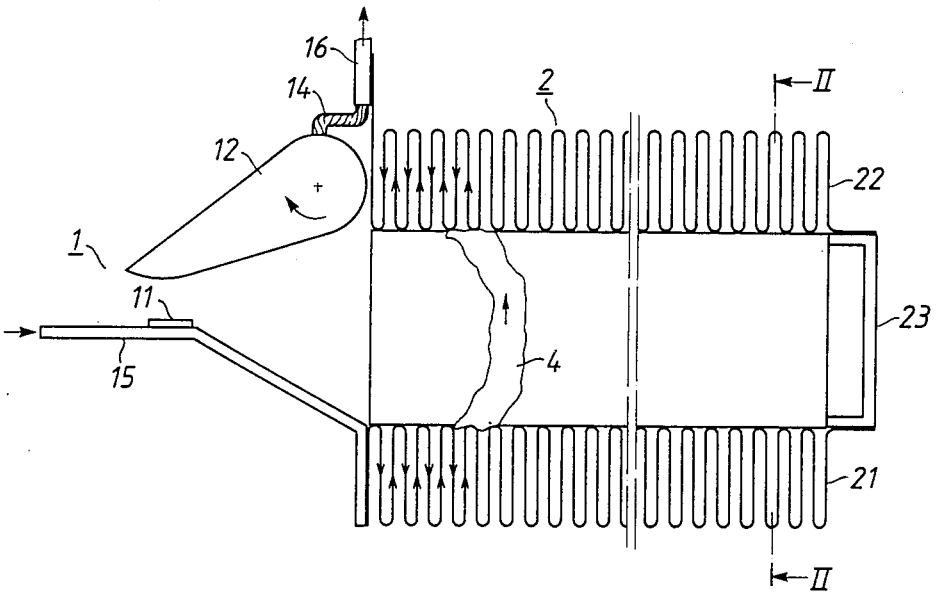
FIG. 1 is a schematic side view of a first embodiment of a current limiter designed according to the invention.
Figure 2:
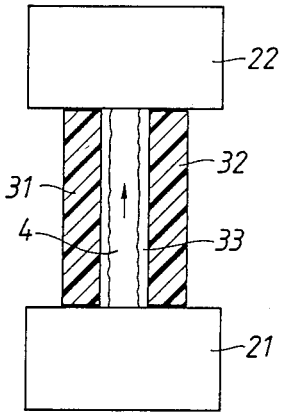
FIG. 2 is a section taken along the line II—II of FIG. 1.

The current limiter shown in FIGS. 1 and 2 comprises a contact means 1 comprising a fixed contact 11 and a contact 12 which is rotatable about an axis. The contacts 11 and 12 are each connected to a connection member 15 and 16, respectively, for connecting the current limiter into a circuit. The connection between the movable contact 12 and the connection member 16 takes place via a flexible conductor 14.

From the contact means 1 there extends a pair 2 of runner rails consisting of two elongated parallel runner rails 21 and 22. At that end of the rails which is positioned at the contact means 1, each rail is fixedly connected to a respective connection member 15 and 16. At their other end, the rails are fixedly interconnected by means of a rail 23.

Figure 3:
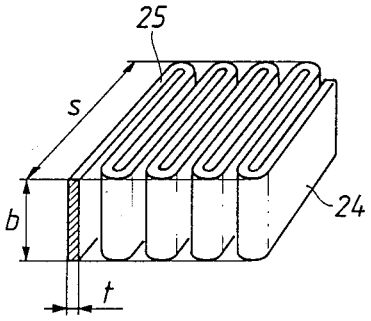
FIG. 3 is a schematic perspective view of a runner rail included in the current limiter.

The runner rails 21, 22 are manufactured from an insulated tape 24 (FIG. 3) of electrically conductive material, for example copper, brass or the like, which has been folded and packed into a solid package of rectangular cross-section. The thickness t and width b of the tape as well as the length of folding s are chosen in view of the system voltage and the material of the tape, so that the desired resistance per unit of length of the rails is achieved. The thickness t of the tape may, for example, lie between 0.1 and 2 mm, the width b between 15 and 100 mm and the length of folding s between 30 and 200 mm. However, these values are stated only as examples and do not at all constitute any minimum or maximum values. For current limiters for intermediate voltage a resistance of, for example 4 mΩ/cm may be suitable, which can be attained by using a copper tape with a thickness of about 0.3 mm, a width of about 20 mm and a length of folding of about 50 mm. The length of the rails may be of the order of magnitude of 1 m.

The runner rails may, for example, be oriented in such a way that confronting surfaces of the rails are formed by the curved portions of the tape, as shown in FIG. 1. The insulation on these surfaces is then removed at least along the mid-portion of the surfaces so as to form running paths for the foot points of the arc.

Between the two rails 21, 22, two parallel walls 31, 32 of insulating material extend, which form between them a gap 33 for the arc, as will be clear from FIG. 2. By making the gap 33 relatively narrow, a considerable amount of energy will be diverted from the arc to the wall while at the same time the velocity of the arc is increased. As material in the walls, different inorganic insulating materials, such as mica glass or aluminium oxide, are feasible. The good thermal conductivity of aluminium oxide is advantageous in this connection. To improve the coefficient of heat transfer between the arc plasma and the walls, the inwardly-facing surfaces of the walls can be made rough, for example by enlargement of the surface in the form of grooves. Also certain organic insulating material, which may possibly give off gas when being heated, may come into question as materials in the walls 31, 32.

When a short-circuit occurs in that circuit into which the current limiter is connected, the contact means 11, 12 is immediately opened by the action of an automatically acting operating device (not shown). The arc 4 which is struck between the contacts 11 and 12, is moved, while being influenced by the magnetic field of the current, into the gap 33 where the foot points of the arc are rapidly moved along the runner rails 21, 22, the resistance of the rails being successively connected into the circuit. Since the tape 24 is thin in relation to the width and forms antiparallel current paths, as shown by arrows in FIG. 1, the inductance of the rails 21, 22 will be very low, which contributes to a rapid arc travelling. The arc 4 approaches the outer ends of the guide rails, which ends are short-circuited through the connecting rail 23, the arc is extinguished. The total resistance of the runner rails will then be inserted into the circuit, thus achieving a considerable limitation of the short-circuit current and a reduction of the phase displacement between current and voltage. The short-circuit current thus limited can easily be broken by a circuit-breaker arranged in series with the current limiter.

Figure 4:
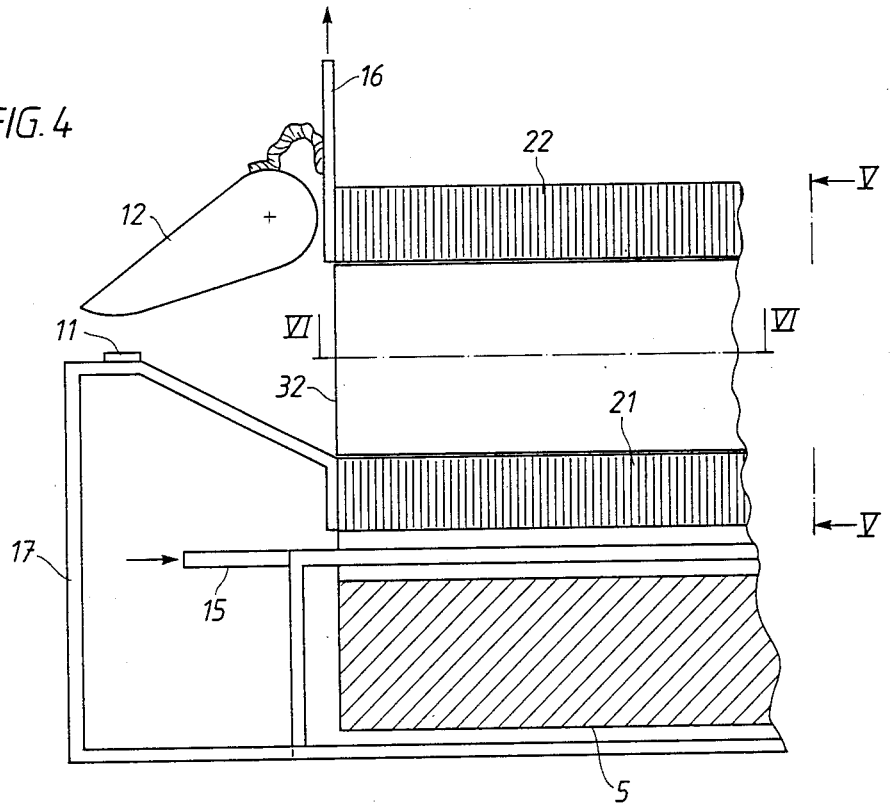
FIG. 4 is a schematic side view of the central part of a second embodiment of a current limiter designed in accordance with the invention.
Figure 5:
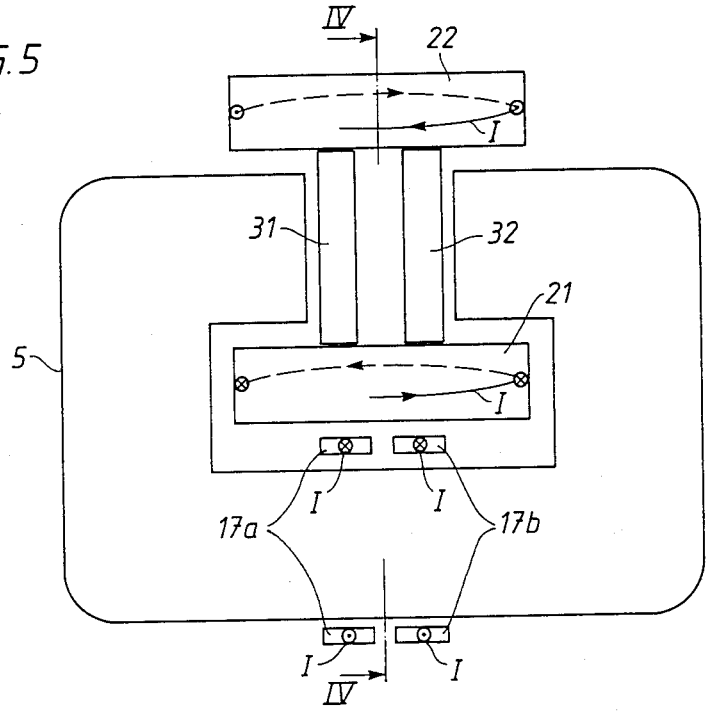
FIG. 5 is a section taken along the line V—V of FIG. 4.

To increase the magnetic field generated by the current in the gap 33, thus achieving a more rapid arc travelling, a magnetic core 5 can be arranged around one of the runner rails, as shown in FIG. 4 and 5. In order further to reinforce the magnetic field, the current conductor 17 between the connection members 15 and 16 is wound two turns around the magnetic core 5 in this embodiment. These turns 17*a*, 17*b* are wound in such a direction that the magnetic field generated by the current therethrough cooperates with the field generated by the current through the runner rails. This is clear from FIG. 5, in which the current direction in the magnetizing turns and the runner rails have been indicated by dots and crosses in the conventional manner.

It is also possible to bring about a reinforcement of the magnetic field without the use of a magnetic core by moving the current conductor in a number of turns along the insulating walls 31, 32. This results in the advantage of the current limiter becoming considerably lighter in weight.

Figure 6:
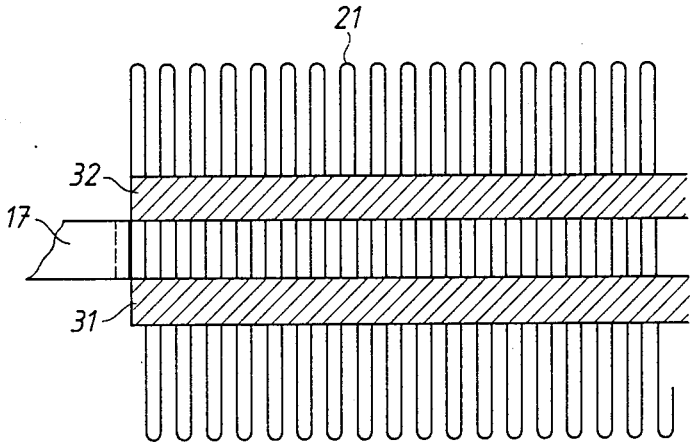
FIG. 6 is a section taken along the line VI—VI of FIG. 4.

In the embodiment according to FIGS. 4–6, in contrast to the embodiment according to FIG. 1, the runner rails are oriented in such a way that the confronting surfaces of the rails are formed of one of the longitudinal edge surfaces of the folded tape. This embodiment is simpler to manufacture than the embodiment according to FIG. 1, since it is easier to achieve even running surfaces if these are formed of the unbroken longitudinal edge surface 25 (FIG. 3) of the folded tape.

Figure 7:
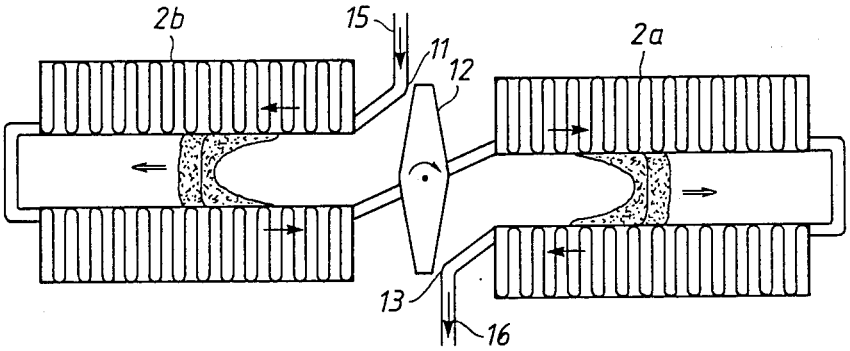
FIG. 7 is a schematic side view of an embodiment of a current limiter with two series-connected runner rail pairs.

Current limiters for higher system voltages are suitably made with several series-connected runner rails. FIG. 7 shows as an example an embodiment having two and FIG. 8 an embodiment having six series-connected runner rail pairs 2*a*–2*f*. The runner rail pairs extend from a common contact means comprising a rotatable contact 12 and two fixed contacts 11, 13 cooperating with contact 12 and being connected to the connection means 15 and 16, respectively.

Figure 8:
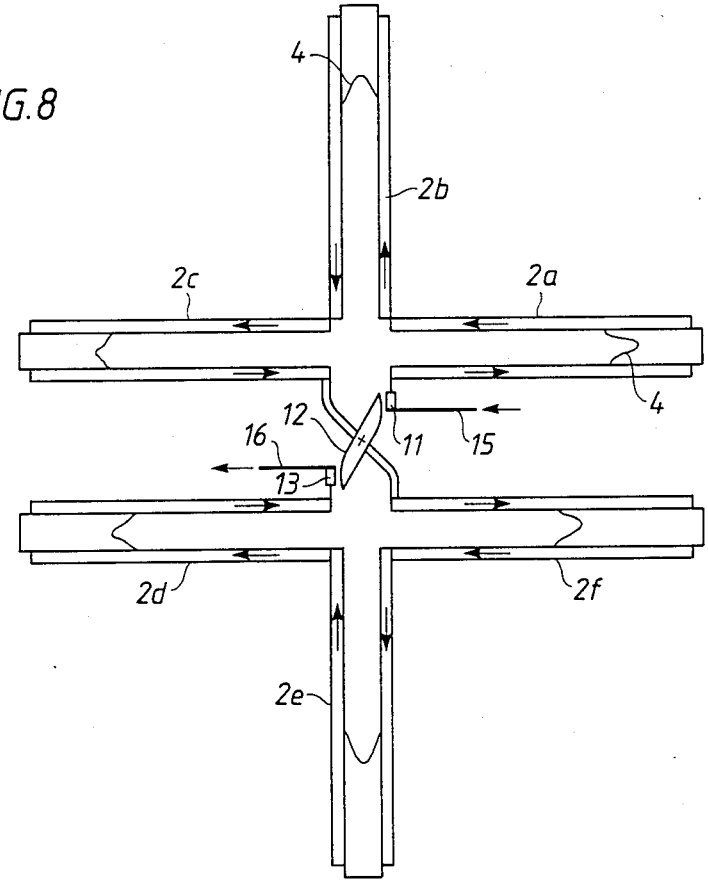
FIG. 8 is a similar view of a current limiter having six series-connected runner rail pairs.

The three runner rail pairs on either side of the contact means in FIG. 8 need not necessarily be arranged perpendicular to each other, as shown in the figure, but may also be arranged, for example, in parallel with each other, which considerably reduces the space requirement.

We claim:

1. A current limiter comprising a contact means having at least two cooperating contacts at least one of which being movable, connecting members for connecting the current limiter into a circuit, and at least two substantially parallel, resistive runner rails adjacent to the contact means, said runner rails causing the arc produced upon contact opening when a short-circuit current flows in the circuit, under the influence of the magnetic field generated by the current, to move away from the contact means with the foot points of the arc running along the rails, an increasing resistance being inserted into the circuit, each runner rail comprises an insulated tape made of an electrically conductive material and being folded and packed to form a solid resistance package, the confronting surfaces of the two runner rails being at least partially uninsulated to form running paths for the foot points of the arc.

2. A current limiter according to claim 1, further comprising a gap between the two rails there is arranged a gap defined by means of walls of insulating material, for containing the arc.

3. A current limiter according to claim 2, wherein those surfaces of the insulating walls facing the gap are rough for improving the heat transfer between the arc and the walls.

4. A current limiter according to claim 1, 2 or 3, wherein the tape consists, at least for the main part, of copper.

5. A current limiter according to claim 2, further comprising members for reinforcing the magnetic field in the arc gap are adjacent to said gap.

6. A current limiter according to claim 5, wherein said magnetic field-reinforcing members comprise a magnetic core surrounding one of the runner rails.

7. A current limiter according to claim 5 or 6, wherein said magnetic field-reinforcing members comprise one or more current loops extending along the runner rails, said current loops being adapted to be traversed by the current in the circuit into which the current limiter is connected.

8. A current limiter according to claim 1, 2 or 5, wherein the confronting surfaces of the two runner rails are formed of one of the longitudinal edge surfaces of the folded tape.

9. A current limiter according to claim 1, 2 or 5, wherein the confronting surfaces of the two runner rails are formed of curved portions of the folded tape.

10. A current limiter according to claim 1, 2, 5 or 6, further comprising a plurality of runner rail pairs extending from a common contact means.

* * * * *

UNITED STATES PATENT AND TRADEMARK OFFICE

CERTIFICATE OF CORRECTION

PATENT NO. : 4,714,974

DATED : Dec. 22, 1987

INVENTOR(S) : Schreurs et al

It is certified that error appears in the above-identified patent and that said Letters Patent is hereby corrected as shown below:

ON THE TITLE PAGE:
The second inventor's name should be Stefan Toader.

Column 1, line 17, "limited" should be --limiter--.
Column 2, line 1, "which" should be deleted.
Column 2, line 12, "foled" should be --folded--.
Claim 2, column 4, lines 56-57, "there is arranged a gap" should be deleted.
Claim 5, column 4, last line, "are" should be deleted.

Signed and Sealed this

Thirty-first Day of January, 1989

*Attest:*

DONALD J. QUIGG

*Attesting Officer*

*Commissioner of Patents and Trademarks*